US010825361B1

(12) United States Patent
Schmidt et al.

(10) Patent No.: US 10,825,361 B1
(45) Date of Patent: Nov. 3, 2020

(54) LOCK INSTRUCTION TAG FOR LUGGAGE SYSTEMS

(71) Applicant: JRSK, Inc., New York, NY (US)

(72) Inventors: Colin Edwin Schmidt, New York, NY (US); Wah Loong Choi, Hong Kong (CN)

(73) Assignee: JRSK, Inc., New York, NY (US)

( * ) Notice: Subject to any disclaimer, the term of this patent is extended or adjusted under 35 U.S.C. 154(b) by 0 days.

(21) Appl. No.: 16/544,482

(22) Filed: Aug. 19, 2019

(51) Int. Cl.
*G09F 3/02* (2006.01)
*E05B 37/02* (2006.01)

(52) U.S. Cl.
CPC ..... *G09F 3/02* (2013.01); *E05B 37/02* (2013.01); *G09F 2003/0254* (2013.01)

(58) Field of Classification Search
CPC ..... G09F 3/02; G09F 2003/0254; E05B 32/02
See application file for complete search history.

(56) References Cited

U.S. PATENT DOCUMENTS 3,597,945 A * 8/1971 Feinberg ..... A44B 19/301 70/68
3,598,436 A * 8/1971 Scelba ..... A44B 19/301 292/183
4,634,849 A * 1/1987 Klingen ..... B07C 5/3412 235/487
4,722,208 A * 2/1988 Ye ..... E05B 37/02 70/312
6,550,813 B1 * 4/2003 Siegrist ..... B42D 15/0093 283/107
2011/0142375 A1 * 6/2011 Lebow ..... B65D 55/145 383/64
2012/0010895 A1 * 1/2012 Versteeg ..... G09F 3/14 705/1.1
2015/0128666 A1 * 5/2015 Thomson ..... E05B 65/5284 70/67
2016/0113371 A1 * 4/2016 Dunn ..... A45C 13/103 70/21

* cited by examiner

*Primary Examiner* — Gary C Hoge
(74) *Attorney, Agent, or Firm* — Proskauer Rose LLP

(57) ABSTRACT

A lock instruction tag for providing instructions to a user for opening locking mechanisms of luggage systems. The lock instruction tag includes a first portion having instructions for opening a luggage system and a second portion having an opening. The opening is sized to receive at least a portion of a zipper head of the luggage system.

20 Claims, 3 Drawing Sheets

LOCK INSTRUCTION TAG FOR LUGGAGE SYSTEMS

FIELD OF THE INVENTION

The present invention relates generally to systems and methods for removing instruction tags from luggage systems, including systems and methods for removing instruction tags from locking mechanisms of luggage systems.

BACKGROUND OF THE INVENTION

With the evolution of luggage systems over the past 100 years, some luggage systems can include locking mechanisms to provide a user with the option of securing their luggage during transportation. Often, the locking mechanisms are initially configured such that the user can open the luggage and personalize the configuration of the locking mechanism once opened. For example, the locking mechanism can be initially configured to be unlocked by setting a numerical combination to 000. Once opened, the user can change the unlocking numerical combination.

Instructions are usually provided so that the user understands how to operate the locking mechanism and becomes aware of the initial configuration. Traditionally, instructions are provided on a hanging tag or a sticker. Hanging tags are undesirable because they may be damaged during transportation. Stickers are often left on the luggage by the consumer or, if removed, leave undesirable residue where it was located. Consequently, there is a need for a better solution to provide instructions to consumers for operating locking mechanisms of luggage systems.

SUMMARY OF THE INVENTION

Accordingly, an object of the invention is to provide users with a lock instruction tag having instructions for opening a locking mechanism of a luggage system. It is an object of the invention to provide users with systems and methods to permit the user to remove the instruction tag from the locking mechanism of the luggage system. It is an object of the invention to permit the instruction tag to be secured by the locking mechanism, such that the instruction tag is released once a consumer opens the luggage system. It is an object of the invention to permit the instruction tag to be released once a consumer opens the locking mechanism of the luggage system, increasing the ease of removal of the instruction tag and preventing the instruction tag from being left on the luggage system by the user when the luggage system is in use, e.g., during travel.

In some aspects, a lock instruction tag comprises a first portion having instructions for opening a luggage and a second portion having an opening. The opening is sized to receive at least a portion of a zipper head.

In some embodiments, the lock instruction tag is proximate a locking mechanism of the luggage. The lock instruction tag may be removable from the luggage.

In some embodiments, the opening is one of two or more openings. Each of the openings may be sized to receive at least a portion of a zipper head.

In some embodiments, the instructions comprises an image representing a locking mechanism of the luggage. The instructions may also comprise text representing steps for opening the luggage. In some embodiments, the instructions comprises two or more images representing a locking mechanism of the luggage.

In some embodiments, the lock instruction tag is made of a material comprising at least one of paper, plastic, and metal. In some embodiments, the first portion is made of a first material having a first elastic modulus and the second portion is made of a second material having a second elastic modulus. The second elastic modulus may be greater than the first elastic modulus.

In some aspects, a method for removing a lock instruction tag from a luggage comprises setting a locking mechanism of the luggage to an opening state, actuating the locking mechanism of the luggage, and clearing an opening of the lock instruction tag from a zipper head of the luggage.

In some embodiments, setting the locking mechanism of the luggage to the opening state comprises setting a combination of the locking mechanism to a default value. In some embodiments, actuating the locking mechanism of the luggage comprises sliding a lock of the locking mechanism.

In some embodiments, the opening is sized to receive at least a portion of the zipper head of the luggage. In some embodiments, the lock instruction tag comprises instructions for opening the luggage.

Other aspects and advantages of the invention can become apparent from the following drawings and description, all of which illustrate the principles of the invention, by way of example only.

BRIEF DESCRIPTION OF THE DRAWINGS

The advantages of the invention described above, together with further advantages, may be better understood by referring to the following description taken in conjunction with the accompanying drawings. The drawings are not necessarily to scale, emphasis instead generally being placed upon illustrating the principles of the invention.

DETAILED DESCRIPTION OF THE INVENTION

In some aspects, the systems and methods described herein can include one or more mechanisms or methods for providing a user instructions for opening a locking mechanism of a luggage system. The system and methods can include a lock instruction tag having instructions for opening the locking mechanism of the luggage system. The systems and methods described herein can permit a user to remove the instruction tag from the locking mechanism of the luggage system. The system and methods described herein can permit the instruction tag to be secured by the locking mechanism, such that the instruction tag is released once a consumer opens the luggage system.

Figure 1:
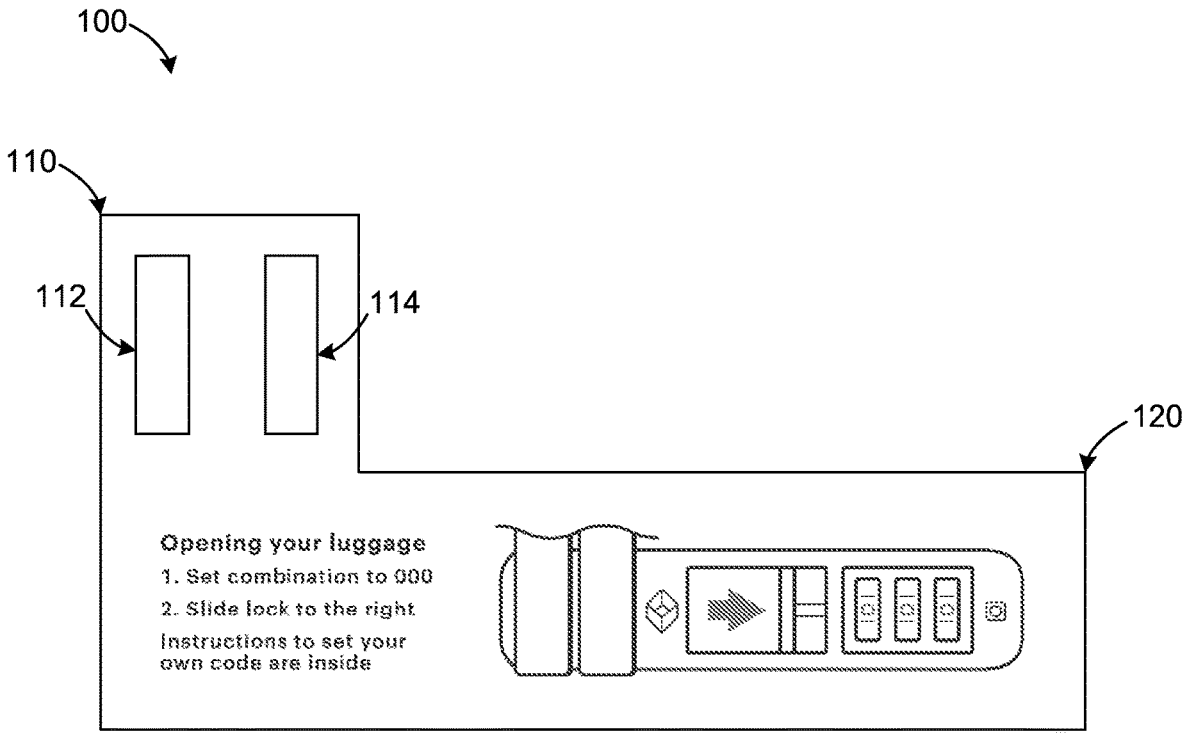
FIG. 1 is a front view of an exemplary lock instruction tag according to an embodiment of the invention.

Referring to FIG. 1, an example lock instruction tag 100 can include a lock area 110 and an instruction area 120. The instruction area 120 can include instructions for opening the locking mechanism of a luggage system. For example, the instruction area 120 can include one or more images representing a locking mechanism of the luggage system. The instruction area 120 can also include text representing steps for opening the luggage system. The one or more images and/or text in the instruction area 120 can provide a user with instructions for opening the locking mechanism of the luggage system. In some embodiments, the lock instruction tag 100 can be proximate to the locking mechanism of the luggage system in order to facilitate the user during the opening of the luggage system.

Lock area 110 of instruction tag 100 can include openings 112 and 114. The openings 112 and 114 can be sized to receive at least a portion of a zipper head of a luggage system. For example, locking mechanisms of luggage systems often secure zipper heads in place using a lock. The zipper head is inserted into the lock and is secured until a user unlocks the locking mechanism. Lock area 110 can be secured in place by being located between the zipper and the locking mechanism. Openings 112 and 114 can be sized such that at least a portion of a zipper head can fit within but allows for the lock area 110 to be secure between the zipper and the locking mechanism. In some embodiments, lock area 110 can include only one of openings 112 and 114. For example, locking area 110 may have one opening if the luggage system has one zipper that is locked with the locking mechanism.

The lock instruction tag 100 can be made of a material that is stiff enough to withstand potential damage during transportation. For example, lock instruction tag 100 can be made of a material comprising at least one of paper, plastic, and metal. In some embodiments, different portions of the lock instruction tag 100 can be made of different materials. For example, instruction area 120 can comprise a first material having a first elastic modulus, and lock area 110 can comprise a second material having a second elastic module. In some embodiments, the second elastic modulus is greater than the first elastic modulus such that the lock area 110 is stiffer than the instruction area 120. This embodiment allows for the lock area 110 to be stiff enough to be secured by the locking mechanism while permitting the instruction area 120 to be flexible.

Figure 2:
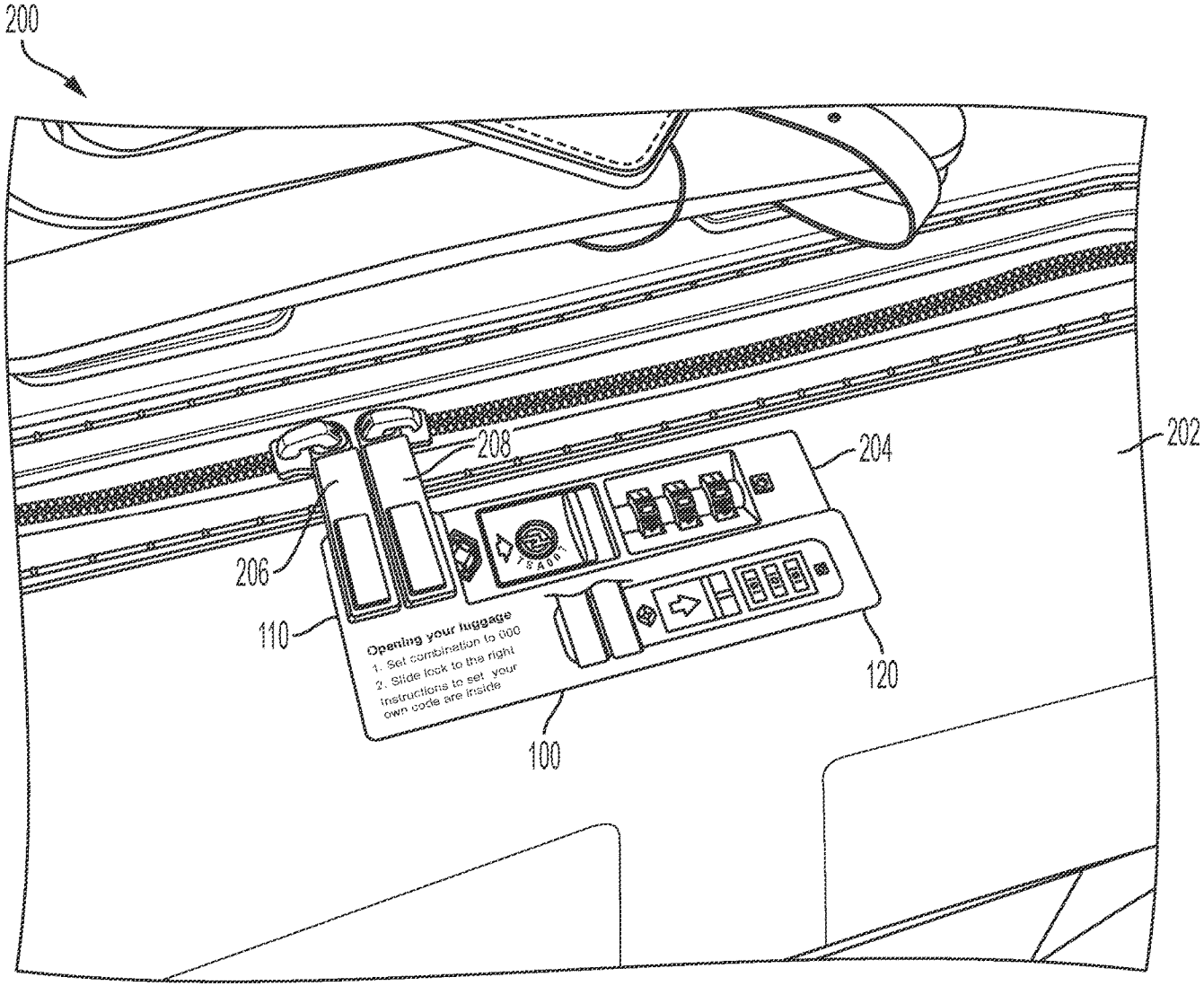
FIG. 2 is an isometric view of an exemplary luggage system with the lock instruction tag shown in FIG. 1 according to an embodiment of the invention.

Referring to FIG. 2, an example embodiment 200 can include a luggage system 202 having a locking mechanism 204 and zipper heads 206 and 208. As described in relation to FIG. 1, the lock instruction tag 100 can be proximate to the locking mechanism 204 of the luggage system 202 in order to facilitate the user during the opening of the luggage system 202. For example, locking mechanism 204 of luggage system 202 can secure zipper heads 206 and 208 in place. The zipper heads 206 and 208 is inserted into the locking mechanism 204 and is secured until a user unlocks the locking mechanism 204. Lock area 110 can be secured in place by being located between the zipper heads 206 and 208 and the locking mechanism 204. Openings 112 and 114 can be sized such that at least a portion of a zipper heads 206 and 208 can fit within but allows for the lock area 110 to be secure between the zipper heads 206 and 208, and the locking mechanism 204. The process of securing the lock instruction tag 100 to the luggage system 202 can be performed by, for example, a manufacturer or a distributor at the point of sale, or the like.

Figure 3:
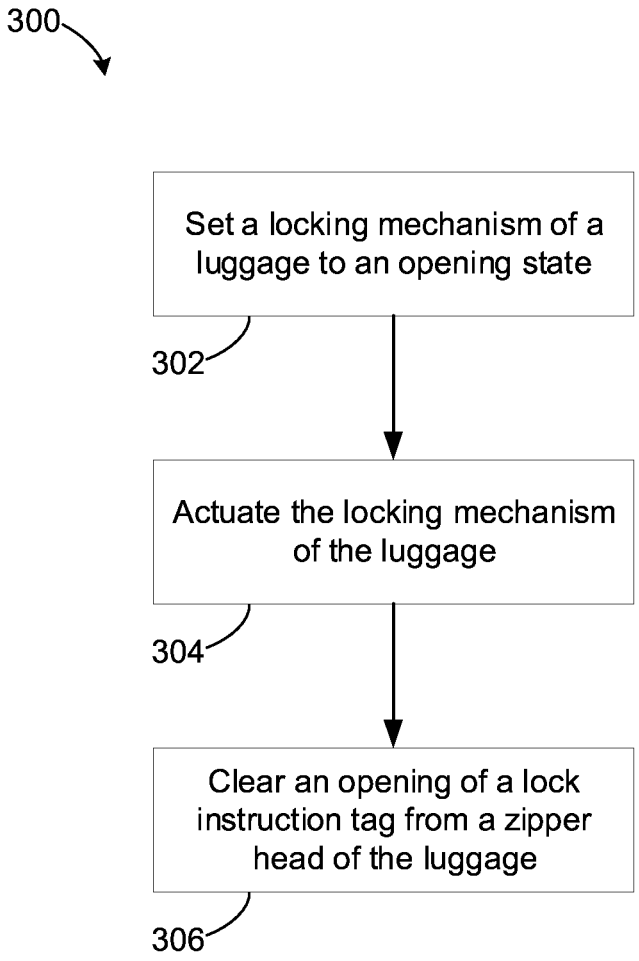
FIG. 3 is a flow diagram of method steps for removing the lock instruction tag shown in FIG. 1 from the luggage system shown in FIG. 2 according to an embodiment of the invention.

Referring to FIG. 3, a process 300 for removing a lock instruction tag 100 from a luggage system 202 is illustrated. As described in relation to FIGS. 1 and 2, the lock instruction tag 100 can include a lock area 110 and an instruction area 120. The lock area 110 can include one or more openings 112 and 114 that are sized to receive at least a portion of a zipper head 206 and/or 208 of a luggage system 202. The instruction area 120 can include instructions for opening the locking mechanism 204 of a luggage system 202.

The process 300 begins by setting a locking mechanism 204 of the luggage system 202 to an opening state in step 302. For example, a user can set a combination of the locking mechanism 204 to a default value. In some embodiments, the default value can be 000. The default value can be illustrated in the instruction area 120 in the form of one or more images and/or text. For example, the instruction area 120 can include one of more images illustrating the locking mechanism 204 having the numerical combination set at the default value. In some embodiments, the default value in the one or more images can be emphasized. For example, the default value can be a different color compared to the rest of the image or images.

Process 300 continues by actuating the locking mechanism 204 of the luggage system 202 in step 304. For example, the user can slide a lock of the locking mechanism 204. In some embodiments, instruction area 120 can include one or more images illustrating the actuating process of the locking mechanism 204. For example, instruction area 120 can include one or more images illustrating one or more arrows indicating the unlocking direction for sliding the lock of the locking mechanism 204. In some embodiments, the one or more arrows can be emphasized. For example, the one or more arrows can be a different color compared to the rest of the image or images. In some embodiments, the default value and one or more arrows can be the same color.

Process 300 finishes by clearing the opening 112 of the lock instruction tag 100 from the zipper head 206 and/or 208 in step 306. For example, once the user slides the lock of the locking mechanism, the zipper head 206 and/or 208 can be released from the locking mechanism 204, clearing the opening 112 of the lock instruction tag 100. In some embodiments, both of openings 112 and 114 are cleared after the user actuates the locking mechanism 204. The user can remove the lock instruction tag 100 from the locking mechanism 204 of the luggage system 202 once openings 112 and/or 114 are cleared from the zipper head.

One skilled in the art will realize the invention can be embodied in other specific forms without departing from the spirit or essential characteristics thereof. The foregoing embodiments are therefore to be considered in all respects illustrative rather than limiting of the invention described herein. It will be appreciated that the illustrated embodiments and those otherwise discussed herein are merely examples of the invention and that other embodiments, incorporating changes thereto, including combinations of the illustrated embodiments, fall within the scope of the invention.

What is claimed:

1. A lock instruction tag proximate a locking mechanism of a luggage, comprising:

a first portion having instructions for opening the luggage; and a second portion having an opening, wherein the opening is sized to receive at least a portion of a zipper head, and wherein the lock instruction tag is attached using the portion of the zipper head.

2. The lock instruction tag of claim 1, wherein the lock instruction tag is removable from the luggage.

3. The lock instruction tag of claim 1, wherein the opening is one of a plurality of openings.

4. The lock instruction tag of claim 3, wherein each of the plurality of openings is sized to receive at least a portion of a zipper head.

5. The lock instruction tag of claim 1, wherein the instructions comprises an image representing a locking mechanism of the luggage.

6. The lock instruction tag of claim 5, wherein the instructions further comprises text representing a plurality of steps for opening the luggage.

7. The lock instruction tag of claim 1, wherein the instructions comprises a plurality of images representing a locking mechanism of the luggage.

8. The lock instruction tag of claim 1, wherein the lock instruction tag is made of a material comprising at least one of paper, plastic, and metal.

9. The lock instruction tag of claim 1, wherein the first portion is made of a first material having a first elastic modulus and the second portion is made of a second material having a second elastic modulus.

10. The lock instruction tag of claim 9, wherein the second elastic modulus is greater than the first elastic modulus.

11. A method for removing a lock instruction tag from a luggage, the lock instruction tag comprising an opening sized to receive at least a portion of a zipper head of the luggage, the method comprising:

setting a locking mechanism of the luggage to an opening state;

actuating the locking mechanism of the luggage; and clearing the opening of the lock instruction tag from the zipper head.

12. The method of claim 11, wherein setting the locking mechanism of the luggage to the opening state comprises setting a combination of the locking mechanism to a default value.

13. The method of claim 11, wherein actuating the locking mechanism of the luggage comprises sliding a lock of the locking mechanism.

14. The method of claim 11, wherein the lock instruction tag further comprises instructions for opening the luggage.

15. A lock instruction tag proximate a locking mechanism of a luggage, comprising:

a first portion having instructions for opening the luggage; and a second portion having an opening, wherein the opening is sized to receive at least a portion of a zipper head, and wherein the lock instruction tag is on a substantially parallel plane as the locking mechanism.

16. The lock instruction tag of claim 15, wherein the lock instruction tag is removable from the luggage.

17. The lock instruction tag of claim 15, wherein the opening is one of a plurality of openings.

18. The lock instruction tag of claim 17, wherein each of the plurality of openings is sized to receive at least a portion of a zipper head.

19. The lock instruction tag of claim 15, wherein the first portion is made of a first material having a first elastic modulus and the second portion is made of a second material having a second elastic modulus.

20. The lock instruction tag of claim 19, wherein the second elastic modulus is greater than the first elastic modulus.

* * * * *